US007911145B2

(12) United States Patent
Gorrell et al.

(10) Patent No.: US 7,911,145 B2
(45) Date of Patent: Mar. 22, 2011

(54) SPIRAL ELECTRON ACCELERATOR FOR ULTRA-SMALL RESONANT STRUCTURES

(75) Inventors: Jonathan Gorrell, Gainesville, FL (US); Mark Davidson, Florahome, FL (US)

(73) Assignee: Virgin Islands Microsystems, Inc., Saint Thomas (VG)

( * ) Notice: Subject to any disclaimer, the term of this patent is extended or adjusted under 35 U.S.C. 154(b) by 0 days.

(21) Appl. No.: 12/636,154

(22) Filed: Dec. 11, 2009

(65) Prior Publication Data

US 2010/0277066 A1 Nov. 4, 2010

Related U.S. Application Data

(62) Division of application No. 11/418,294, filed on May 5, 2006, now Pat. No. 7,656,094.

(51) Int. Cl.
*H01J 23/02* (2006.01)

(52) U.S. Cl. ..... 315/5.38; 315/5.43; 315/500

(58) Field of Classification Search ..... 315/5, 5.37, 315/5.38, 5.43, 500, 501, 505; 250/396 R, 250/397, 492.1, 492.21, 494.1
See application file for complete search history.

(56) References Cited

U.S. PATENT DOCUMENTS 6,525,477 B2 * 2/2003 Small ..... 315/39.51
7,557,365 B2 * 7/2009 Gorrell et al. ..... 250/503.1
7,557,647 B2 * 7/2009 Gorrell et al. ..... 329/346

* cited by examiner

*Primary Examiner* — Jacob Y Choi
*Assistant Examiner* — Jimmy T Vu
(74) *Attorney, Agent, or Firm* — Davidson Berquist Jackson & Gowdey, LLP

(57) ABSTRACT

An electronic transmitter or receiver employing electromagnetic radiation as a coded signal carrier is described. In the transmitter, the electromagnetic radiation is emitted from ultra-small resonant structures when an electron beam passes proximate the structures. In the receiver, the electron beam passes near ultra-small resonant structures and is altered in path or velocity by the effect of the electromagnetic radiation on structures. The electron beam is accelerated within a series of spiral-shaped anodes to an appropriate current density without the use of a high power supply. Instead, a sequence of low power levels is supplied to the sequence of anodes in the electron beam path. The electron beam is thereby accelerated to a desired current density appropriate for the transmitter or receiver application without the need for a high-level power source.

5 Claims, 4 Drawing Sheets

SPIRAL ELECTRON ACCELERATOR FOR ULTRA-SMALL RESONANT STRUCTURES

This is a divisional application of U.S. patent application Ser. No. 11/418,294 filed May 5, 2006 now U.S. Pat. No. 7,656,094, which is incorporated herein by reference.

COPYRIGHT NOTICE

A portion of the disclosure of this patent document contains material which is subject to copyright or mask work protection. The copyright or mask work owner has no objection to the facsimile reproduction by anyone of the patent document or the patent disclosure, as it appears in the Patent and Trademark Office patent file or records, but otherwise reserves all copyright or mask work rights whatsoever.

CROSS-REFERENCE TO RELATED APPLICATIONS

The present invention is related to the following co-pending U.S. Patent applications which are all commonly owned with the present application, the entire contents of each of which are incorporated herein by reference:

1. U.S. patent application Ser. No. 11/238,991, entitled "Ultra-Small Resonating Charged Particle Beam Modulator," filed Sep. 30, 2005;
2. U.S. patent application Ser. No. 10/917,511, entitled "Patterning Thin Metal Film by Dry Reactive Ion Etching," filed on Aug. 13, 2004;
3. U.S. application Ser. No. 11/203,407, entitled "Method Of Patterning Ultra-Small Structures," filed on Aug. 15, 2005;
4. U.S. application Ser. No. 11/243,476, entitled "Structures And Methods For Coupling Energy From An Electromagnetic Wave," filed on Oct. 5, 2005;
5. U.S. application Ser. No. 11/243,477, entitled "Electron beam induced resonance," filed on Oct. 5, 2005;
6. U.S. application Ser. No. 11/325,448, entitled "Selectable Frequency Light Emitter from Single Metal Layer," filed Jan. 5, 2006;
7. U.S. application Ser. No. 11/325,432, entitled, "Matrix Array Display," filed Jan. 5, 2006;
8. U.S. application Ser. No. 11/302,471, entitled "Coupled Nano-Resonating Energy Emitting Structures," filed Dec. 14, 2005;
9. U.S. application Ser. No. 11/325,571, entitled "Switching Micro-resonant Structures by Modulating a Beam of Charged Particles," filed Jan. 5, 2006;
10. U.S. application Ser. No. 11/325,534, entitled "Switching Microresonant Structures Using at Least One Director," filed Jan. 5, 2006;
11. U.S. application Ser. No. 11/350,812, entitled "Conductive Polymers for Electroplating," filed Feb. 10, 2006;
12. U.S. application Ser. No. 11/349,963, entitled "Method and Structure for Coupling Two Microcircuits," filed Feb. 9, 2006;
13. U.S. application Ser. No. 11/353,208, entitled "Electron Beam Induced Resonance," filed Feb. 14, 2006; and
14. U.S. application Ser. No. 11/400,280, entitled "Resonant Detector for Optical Signals," filed Apr. 10, 2006.

FIELD OF THE DISCLOSURE

This relates in general to electron accelerators for resonant structures.

INTRODUCTION

We have previously described in the related applications identified above a number of different inventions involving novel ultra-small resonant structures and methods of making and utilizing them. In essence, the ultra-small resonant structures emit electromagnetic radiation at frequencies (including but not limited to visible light frequencies) not previously obtainable with characteristic structures nor by the operational principles described. In some of those applications of these ultra-small resonant structures, we identify electron beam induced resonance. In such embodiments, the electron beam passes proximate to an ultra-small resonant structure—sometimes a resonant cavity—causing the resonant structure to emit electromagnetic radiation; or in the reverse, incident electromagnetic radiation proximate the resonant structure causes physical effects on the proximate electron beam. As used herein, an ultra-small resonant structure can be any structure with a physical dimension less than the wavelength of microwave radiation, which (1) emits radiation (in the case of a transmitter) at a microwave frequency or higher when operationally coupled to a charge particle source or (2) resonates (in the case of a detector/receiver) in the presence of electromagnetic radiation at microwave frequencies or higher.

Thus, the resonant structures in some embodiments depend upon a coupled, proximate electron beam. We also have identified that the charge density and velocity of the electron beam can have some effects on the response returned by the resonant structure. For example, in some cases, the properties of the electron beam may affect the intensity of electromagnetic radiation. In other cases, it may affect the frequency of the emission.

As a general matter, electron beam accelerators are not new, but they are new in the context of the affect that beam acceleration can have on novel ultra-small resonant structures. By controlling the electron beam velocity, valuable characteristics of the ultra-small resonant structures can be accommodated.

Also, we have previously described in the related cases how the ultra-small resonant structures can be accommodated on integrated chips. One unfortunate side effect of such a placement can be the location of a relatively high-powered cathode on or near the integrated chip. For example, in some instances, a power source of 100 s or 1000 s eV will produce desirable resonance effects on the chip (such applications may—but need not—include intra-chip communications, inter-chip communications, visible light emission, other frequency emission, electromagnetic resonance detection, display operation, etc.) Putting such a power source on-chip is disadvantageous from the standpoint of its potential affect on the other chip components although it is highly advantageous for operation of the ultra-small resonant structures.

We have developed a system that allows the electrons to gain the benefit usually derived from high-powered electron sources, without actually placing a high-powered electron source on-chip.

THE PRESENTLY PREFERRED EXEMPLARY EMBODIMENTS

Transmitter 10 includes ultra-small resonant structures 12 that emit encoded light 15 when an electron beam 11 passes proximate to them. Such ultra-small resonant structures can be one or more of those described in U.S. patent application Ser. Nos. 11/238,991; 11/243,476; 11/243,477; 11/325,448; 11/325,432; 11/302,471; 11/325,571; 11/325,534; 11/349,963; and/or 11/353,208, (each of which is identified more particularly above). The resonant structures in the transmitter can be manufactured in accordance with any of U.S. application Ser. Nos. 10/917,511; 11/350,812; or 11/203,407, (each of which is identified more particularly above) or in other ways. Their sizes and dimensions can be selected in accordance with the principles described in those and the other above-identified applications and, for the sake of brevity, will not be repeated herein. The contents of the applications described above are assumed to be known to the reader.

Figure 1:
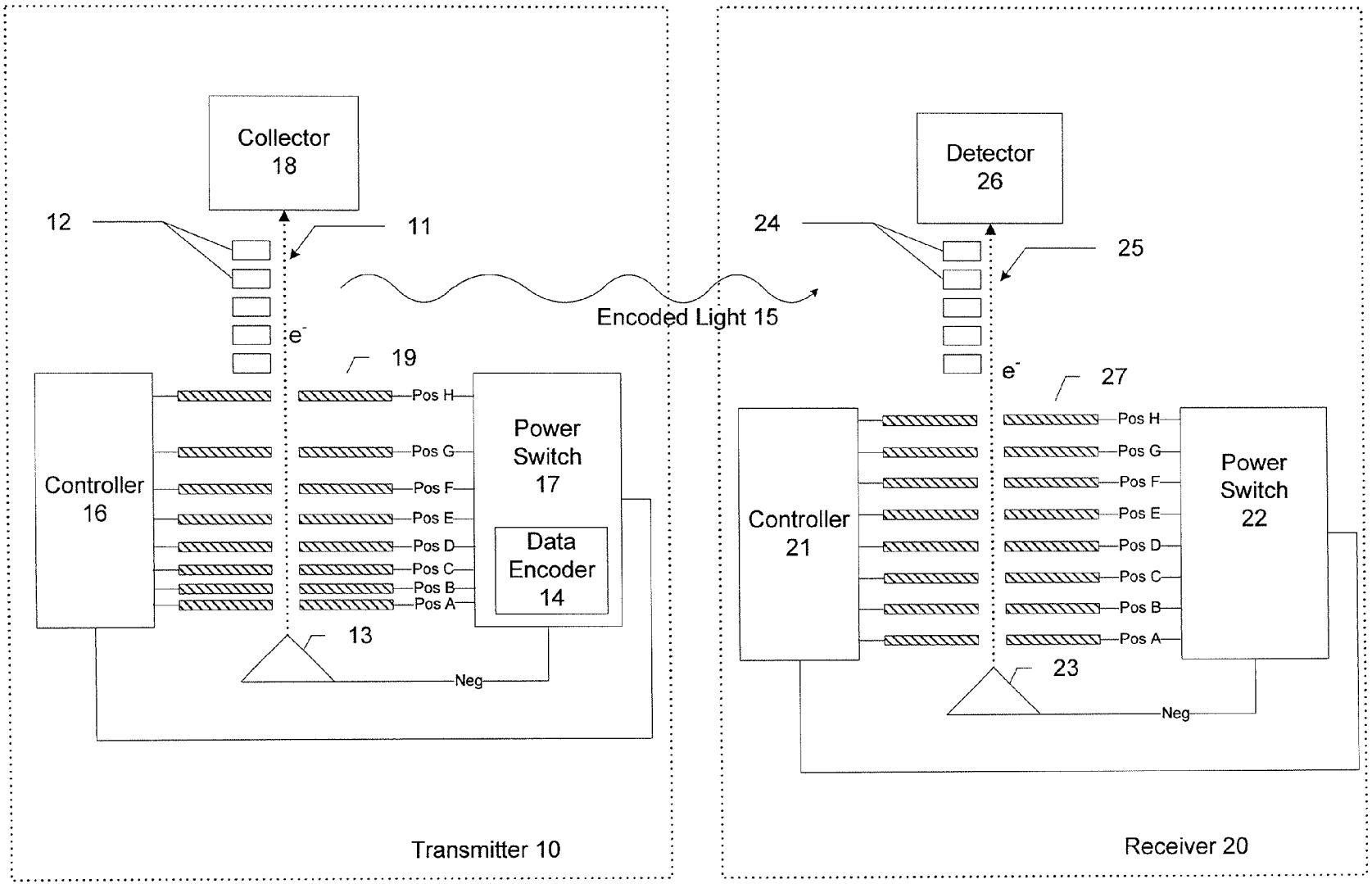
FIG. 1 is a schematic view of a transmitter and detector employing ultra-small resonant structures and two alternative types of electron accelerators.

The ultra-small resonant structures have one or more physical dimensions that can be smaller than the wavelength of the electromagnetic radiation emitted (in the case of FIG. 1, encoded light 15, but in other embodiments, the radiation can have microwave frequencies or higher). The ultra-small resonant structures operate under vacuum conditions. In such an environment, as the electron beam 11 passes proximate the resonant structures 12, it causes the resonant structures to resonate and emit the desired encoded light 15. The light 15 is encoded by the electron beam 11 via operation of the cathode 13 by the power switch 17 and data encoder 14.

In a simple case, the encoded light 15 can be encoded by the data encoder 14 by simple ON/OFF pulsing of the electron beam 11 by the cathode 13. In more sophisticated scenarios, the electron density may be employed to encode the light 15 by the data encoder 14 through controlled operation of the cathode 13.

In the transmitter 10, if an electron acceleration level normally developed under a 4000 eV power source (a number chosen solely for illustration, and could be any energy level whatsoever desired) is desired, the respective anodes connected to the Power Switch 17 at Positions A-H will each have a potential relative to the cathode of 1/n times the desired power level, where n is the number of anodes in the series. Any number of anodes can be used. In the case of FIG. 1, eight anodes are present. In the example identified above, the potential between each anode and the cathode 13 is 4000V/8=500V per anode.

The Power switch 13 then requires only a 500V potential relative to ground because each anode only requires 500V, which is vastly an advantageously lower potential on the chip than 4000V.

Figure 2:
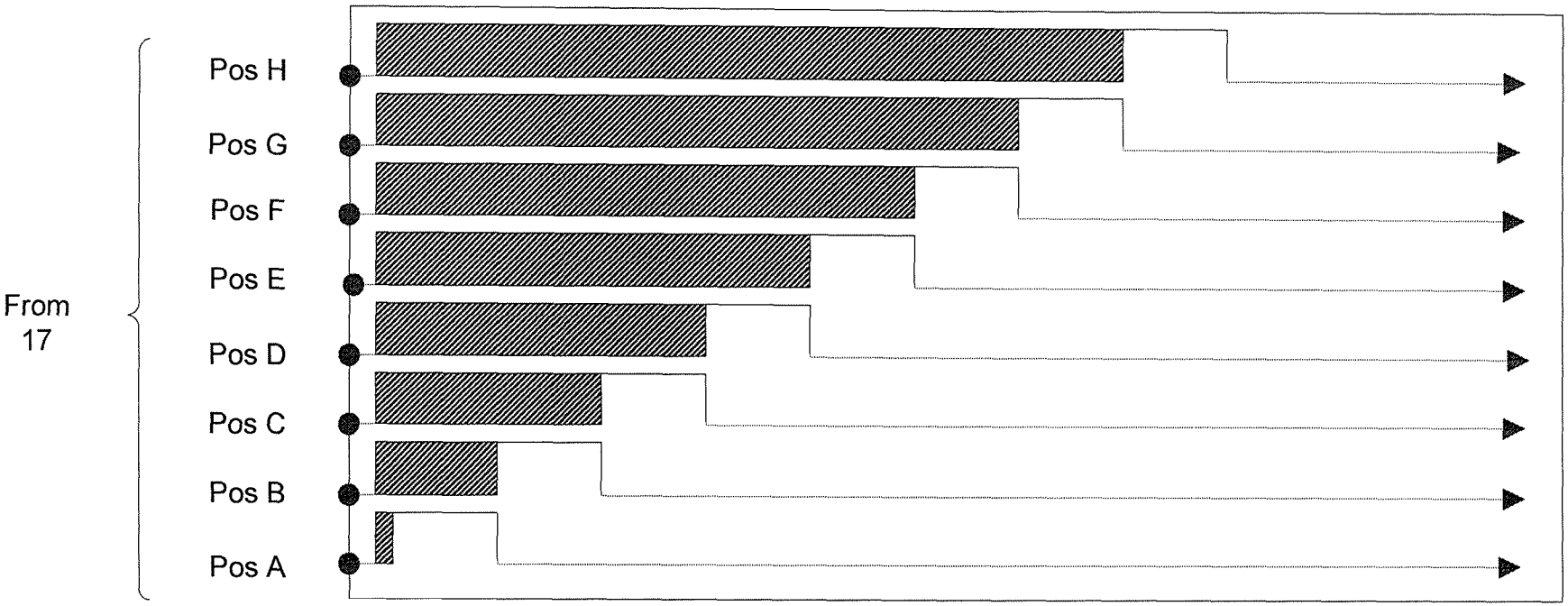
FIG. 2 is a timing diagram for the electron accelerator in the transmitter of FIG. 1.

In the system without multiple anodes, a 500V potential on a single anode will not accelerate the electron beam 11 at nearly the same level as provided by the 4000V source. But, the system of FIG. 1 obtains the same level of acceleration as the 4000V using multiple anodes and careful selection of the anodes at the much lower 500V voltage. In operation, the anodes at Positions A-H turn off as the electron beam passes by, causing the electron beam to accelerate toward the next sequential anode. As shown in the timing diagram of FIG. 2, the power switch 17 controls the potential at each anode in Position A through Position H sequentially as the electron beam passes by the respective anodes. In FIG. 2, the y-axis represents the ON/OFF potential at the anode and the x-axis represents time. At the start, all of the anodes are in a "don't care" state represented by the hatched lines. "Don't care" means that the anodes can be on, off, or switching without material effect on the system. At a particular time, the Position A anode turns ON, as shown, while the remaining anodes remain in the "don't care" state. The ON state indicates a potential between the anode and the cathode 13, such that the electron beam 11 from the cathode 13 is accelerated toward the anode at Position A. Once the electron beam reaches at or near the anode at Position A, the Position A anode turns OFF, as shown in FIG. 2, and the Position B anode turns ON causing the electron beam passing Position A to further accelerate toward Position B. When it reaches at or near Position B, the Position B anode turns off and the Position C anode turns ON, a shown in FIG. 2. The process of turning sequential anodes ON continues, as shown in FIG. 2, as the electron beam reaches at or near each sequential anode position.

After passing Position H in the transmitter 10 of FIG. 1, the electron beam has accelerated to essentially the same level as it would have if only one high voltage anode had been present.

The anodes in transmitter 10 are turned ON and OFF as the electron beam reaches the respective anodes. One way (although not the only way) that the system can know when the electron beam is approaching the respective anodes is to provide controller 16 to sense when an induced current appears on the respective anode caused by the approaching electron beam. When the controller 16 senses a current at a particular threshold level in the anode at Position A, for example, it instructs the power switch 17 to switch the anode at Position A OFF and the anode at Position B ON, and so on, as shown in FIG. 2. The threshold can be chosen to essentially correspond with the approach (or imminent passing) of the electron beam at the particular anode being sensed. The power switch 17 can switch an anode OFF when the threshold is reached under the assumption that the electron beam has sufficiently accelerated to that anode and can now best be further accelerated by attraction to the next sequential anode.

After the electron beam has accelerated to each sequential anode 10, the accelerated electron beam 11 can then pass the resonant structures 12, causing them to emit the electromagnetic radiation encoded by the data encoder 14. The resonant structures 12/24 are shown generically and on only one side, but they may be any of the ultra-small resonant structure forms described in the above-identified applications and can be on both sides of the electron beam. Collector 18 can receive the electron beam and either use the power associated with it for on-chip power or take it to ground.

Figure 3:
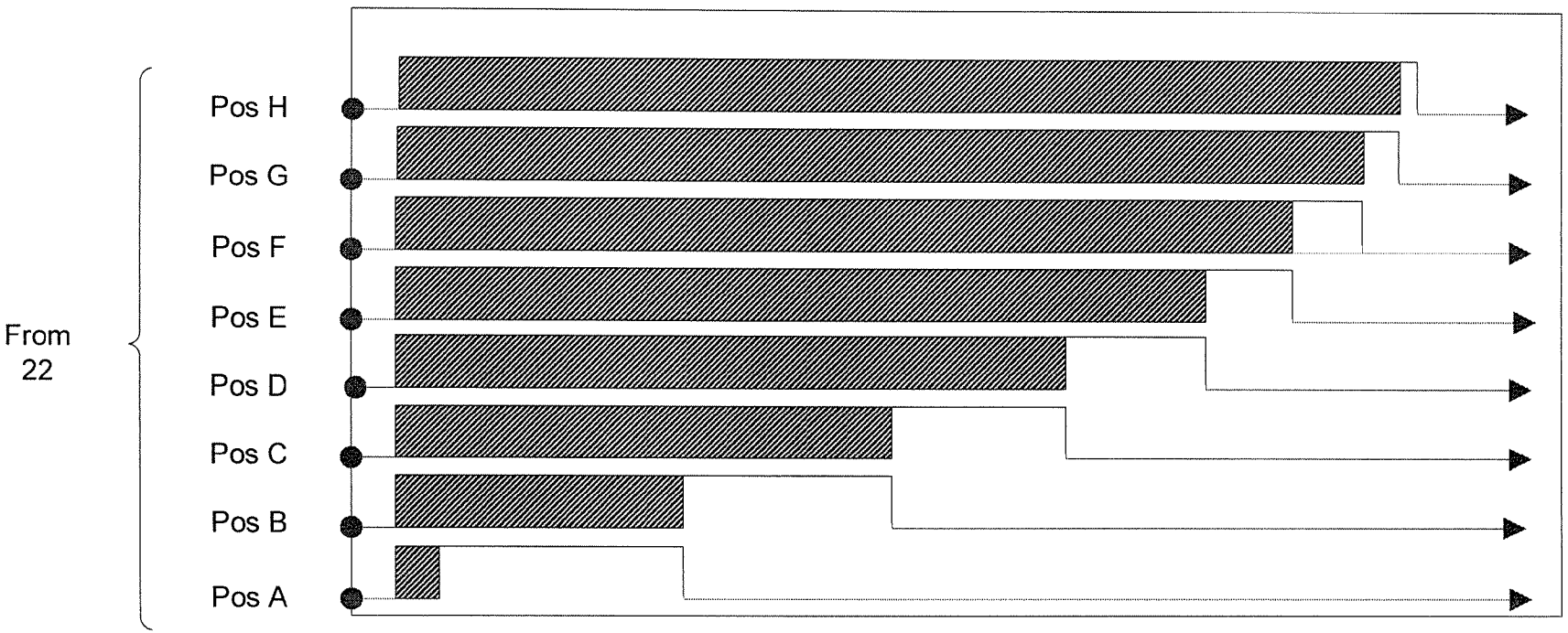
FIG. 3 is a timing diagram for the electron accelerator in the receiver of FIG. 1.

In the transmitter of FIG. 1, each anode is turned ON for the same length of time. Because the electron beam 11 is accelerating as it passes the respective anodes, the anodes 19 are spaced increasingly further apart only the path of the electron beam so the evenly timed ON states will coincide with the arriving electron beam. As can now be understood from that description, the distance between the anodes and the timing of the ON pulses can be varied. Thus, the Receiver 20 in FIG. 1 has a set of anodes 27 that are evenly spaced. In that embodiment, as the electron beam 25 from cathode 23 accelerates, the ON states of the anodes 27 controlled by controller 21 and invoked by power switch 22 at the Positions A-H will shorten as the electron beam approaches the resonant structures 24 (i.e., as the electron beam continues to accelerate). FIG. 3 shows an example timing diagram for the anode switching in the receiver 20 of FIG. 1. As in FIG. 2, the y-axis represents the ON/OFF state (hatched sections represent "don't care") and the x-axis represents time.

In FIG. 3, as the electron beam starts out from cathode 23, it will take more time to reach the anode at Position A and thus the ON state is relatively long. As the electron beam accelerates to Position H, it has substantially increased its velocity such that the ON state for the anode at Position H is relatively short.

Other alternatives systems that incorporate different spacing aspects for the anodes and corresponding different timing aspects will now be apparent to the artisan after reviewing FIGS. 2 and 3. That is, various hybrids between the systems of FIGS. 2 and 3 can be envisioned.

To complete the description of the operation of FIG. 1, in the receiver 20, the electron beam passes the resonant structures 24, which have received the encoded light 15. The effect of the encoded light 15 on the resonant structures 24 causes the electron beam 25 to bend, which is detected by detector 26. In that way, the encoded data in the encoded light 15 is demodulated by detector 26.

To facilitate the acceleration of the electrons between the anodes 19, the electron beam should preferably be pulsed. In that way, one electron pulse can be accelerated to, sequentially, the first, second, third, etc. anodes (Positions A, B, C, etc) before the next pulse of electrons begins. The number of anodes that an earlier pulse of electrons must reach before a next pulse can start will, of course, depend on the influence that the re-energized earlier anodes have on the since-departed electron group. It is advantageous that the re-energizing of the anode at Position A, for example, as a subsequent electron pulse approaches it does not materially slow the earlier electron pulse that is at a later position in the anode stream.

Figure 4:
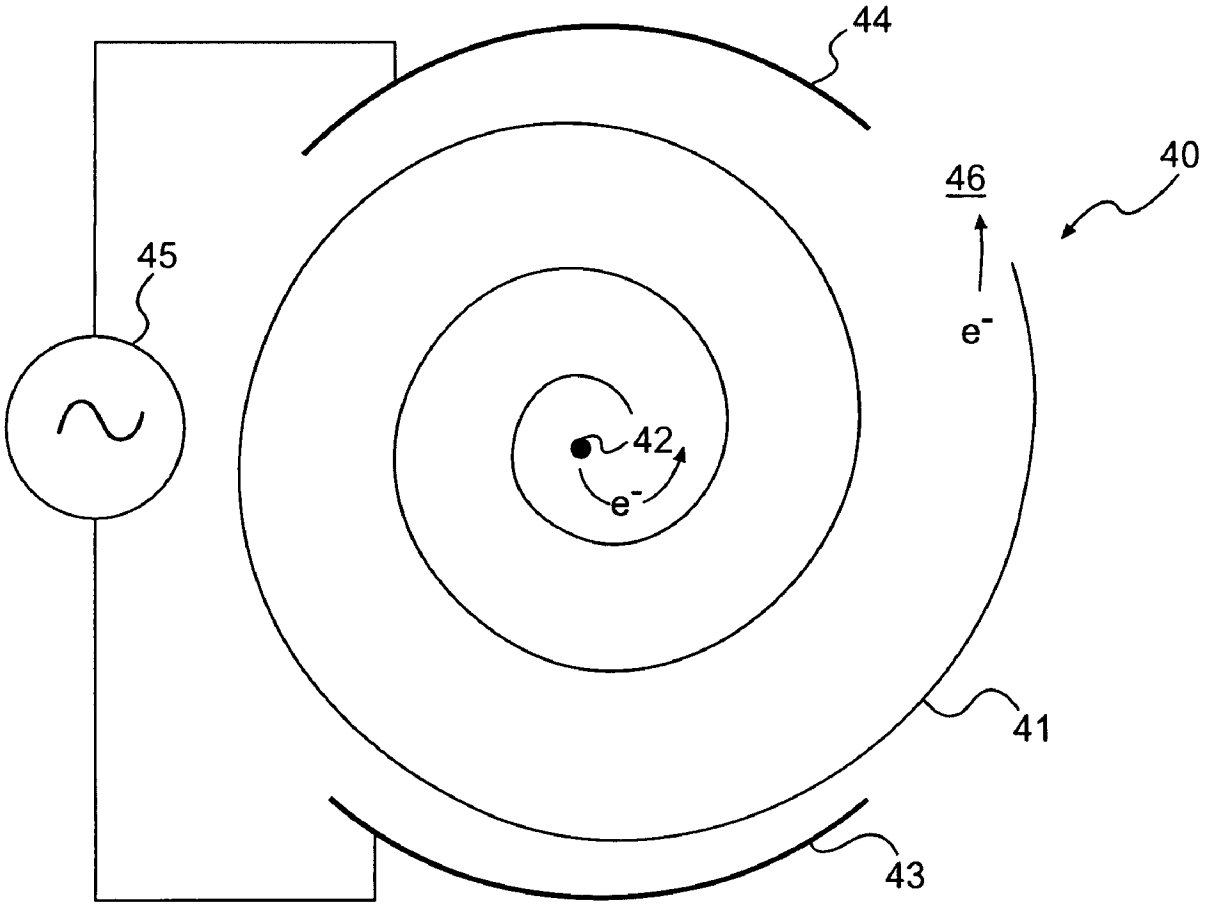
FIG. 4 is another alternative electron accelerator for use with ultra-small resonance structures.

FIG. 4 illustrates an alternative structure for the accelerator 40 that could. substitute for the anodes 19 or the anodes 27. In FIG. 4, a cyclotron is shown in which the cathode 42 emits electrons into a spiral. A magnetic field in a line perpendicular to the plane of FIG. 4, combined with an alternative RF field provided by RF source 45 and electrodes 43 and 44, causes the electron beam from the cathode 42 to accelerate around the spiral. That is, if the polarity transitions between the electrodes 43 and 44 are evenly timed by source 45, then the electrons traveling around each consecutive "ring" of the spiral will travel a longer distance in the same amount of time (hence, their acceleration). When the electrons leave the spiral at position 46, they have accelerated substantially even using a relatively low power source.

The magnetic field in FIG. 4 may be advantageously shielded from other circuit components (for example, when the transmitter and/or receiver are on physically mounted on an IC having other electric components). With shielding, the influence of the magnetic field can be localized to the accelerator 40 without materially affecting other, unrelated elements.

While certain configurations of structures have been illustrated for the purposes of presenting the basic structures of the present invention, one of ordinary skill in the art will appreciate that other variations are possible which would still fall within the scope of the appended claims. While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A system, comprising:

a cathode emitting electrons;

a set of anodes arranged together in a substantially spiral-shape, the cathode situated near a center portion of the spiral-shape;

RF conductors arranged opposing each other near peripheral portions of the spiral-shape;

an alternating power source between the RF conductors; and at least one ultra-small resonant structure downstream of an exit portion of the spiral-shaped set of anodes.

2. A system according to claim 1, wherein the ultra-small resonant structure is a receiver of electromagnetic radiation.

3. A system according to claim 1 wherein the ultra-small resonant structure is a transmitter of electromagnetic radiation.

4. A system according to claim 1 wherein the electrons are emitted to travel through the spiral shape.

5. A system according to claim 4, wherein the alternating power source provides polarity transitions between the respective RF conductors to accelerate the electrons as they travel through the spiral shape.

* * * * *